United States Patent [19]

Lee

[11] 4,147,344

[45] Apr. 3, 1979

[54] TENSIONING TYPE PHYSICAL THERAPEUTICAL TREATMENT DEVICE

[76] Inventor: Arthur L. Lee, 1034 Cameron Rd., Baltimore, Md. 21212

[21] Appl. No.: 812,254

[22] Filed: Aug. 19, 1977

[51] Int. Cl.[2] ..... A63B 21/04

[52] U.S. Cl. ..... 272/136; 272/142; 46/32; 128/25 R; 272/DIG. 4; 73/379; 273/95 A; 272/76

[58] Field of Search ..... 46/32; 272/136, 142, 272/144, 76, DIG. 4, 112; 128/25 R; 73/379

[56] References Cited

U.S. PATENT DOCUMENTS

| | | | |
|---|---|---|---|
| 1,404,894 | 1/1932 | Rollins | 46/32 |
| 1,634,162 | 6/1927 | Tesk | 46/32 |
| 2,303,223 | 11/1942 | Murray et al. | 272/112 X |
| 2,490,230 | 12/1949 | Riegel | 46/32 |
| 2,769,276 | 11/1956 | Steiner | 46/32 |
| 3,564,759 | 2/1971 | Buttermore | 46/32 |
| 3,699,704 | 10/1972 | Hakim | 46/32 |
| 3,978,610 | 9/1976 | Stubbmann | 46/32 |

*Primary Examiner*—Richard C. Pinkham
*Assistant Examiner*—William R. Browne
*Attorney, Agent, or Firm*—Walter G. Finch

[57] ABSTRACT

The invention is a physical therapeutical treatment device for children suffering from diseases, or afflictions such as cerebral palsy. The system is provided with attractive toy-like elements that are associated with various magnitudes of tension elastic to provide several degrees of exercise effort; the attractive toy-like elements inducing participation in the exercise activities. Provisions are included for varying the magnitude of the tension and also varying the height of reach in order to induce greater effort in the exercise, both in the work effort and in the stretching effort.

5 Claims, 4 Drawing Figures

TENSIONING TYPE PHYSICAL THERAPEUTICAL TREATMENT DEVICE

BACKGROUND AND SUMMARY OF THE INVENTION

The invention relates to physical therapeutical treatment systems, in particular to those systems for use by children, and specifically children suffering from diseases, disorders, or afflictions such as, but not limited to, cerebral palsy.

A need has existed for a treatment system for children that would induce voluntary participation by the patient, on a continuing basis, to supplement and complement the treatment provided under direction of an attendant physical therapist or other medically trained personnel.

The need has also existed for a treatment system for children that they would voluntarily use, as a patient and on a continuing basis, that could be adjusted for magnitude of the force required to extend the elastic support; and also, could be adjusted for the extent to which effort had to be exerted to make contact to grasp the elements.

In order to accomplish these objectives, the invented system is equipped with attractive toy-like elements that catch the eye of the child patient and induce participation.

In a like manner for accomplishing the objectives, the invented system is equipped with varying magnitudes of tension elastic to provide several degrees of exercise effort.

Similarly, provisions are included for adjusting and varying the heights of both the main body element of the device and the toy-like elements to induce increased stretching exercising by the patient. This, additionally, requires coordinated efforts by the child patient, an important element in the therapeutical process.

The variation in heights can also be accomplished in a manner that modifies the tension magnitude, thus providing a variety of means for attaining the objectives of both force and stretch type exercise.

It is, therefore, an object of the invention to provide an improved physical therapeutical treatment system for children.

It is another object of the invention to provide an improved physical therapeutical treatment system with attractive toy-like elements to induce participation of child patients.

It is a further object of the invention to provide an improved physical therapeutical system which can be adjusted to provide a range of magnitudes of force to be exerted by child patients.

It is still further an object of the invention to provide an improved physical therapeutical system which can be adjusted to provide a range of heights of the apparatus in order to induce coordinated effort by child patients to reach the exercising units of the system.

Further objects and advantages of the invention will become more apparent in light of the following description of the following description of the preferred embodiments.

DESCRIPTION OF THE PREFERRED EMBODIMENTS

Figure 1:
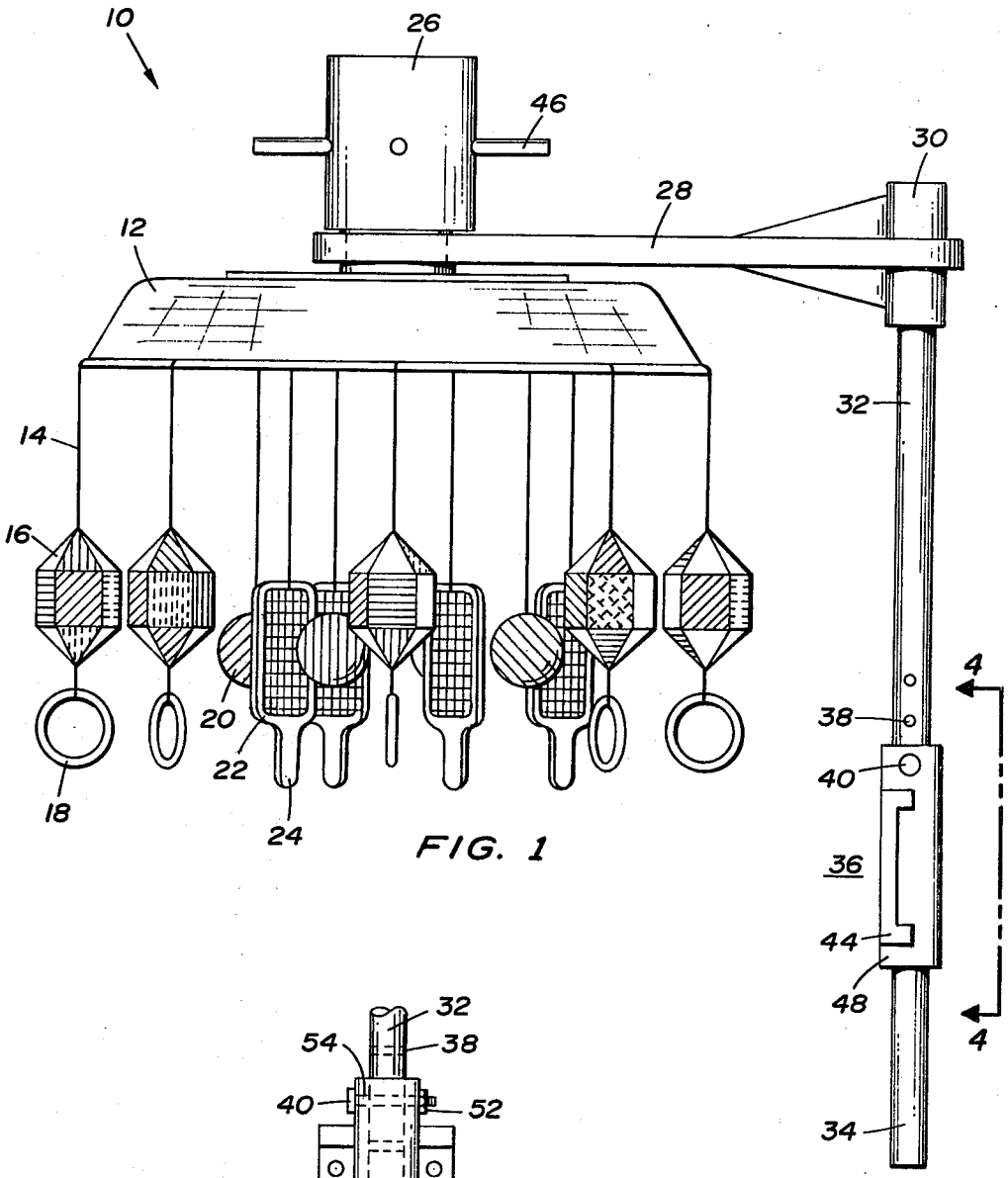
FIG. 1 is a side elevation of the Physical Therapeutical Treatment System.

Referring now to the drawings, and particularly to FIG. 1, an improved physical therapeutical treatment system is shown at 10. The principle parts of the structure of the treatment system 10 will be fully described hereinafter. Those principle parts of the treatment system 10 consist of a main carrier body 12, attractive toy-like elements 16, 18, 20, 22, and 24 (to be described in detail below), elastic supports 14, a support arm 28, a support post 32, and a mounting bracket 36.

Other parts associated with the aforementioned principle parts will be described later in conjunction with their functioning with the principle parts of the structure of the system.

The main carrier body 12 is circular in configuration and shaped in a dish-type fashion. It should be noted, however, that a main carrier body that is square, octogan, or any other configuration is within the scope and intent of this invention, including the fact that it may be flat, corrugated or any other cross sectional shape.

The main carrier body 12 may be woven reed or fiber, plastics, aluminum or any other similar material.

Figure 3:
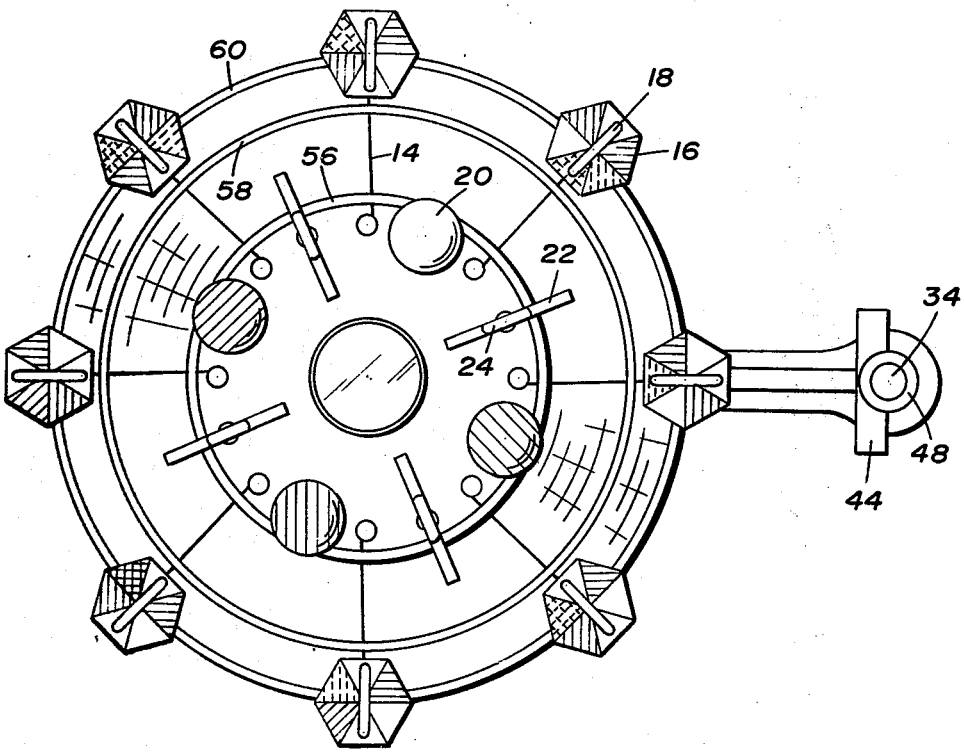
FIG. 3 is a bottom plan view of the Physical Therapeutical Treatment System.

Hanging from the aforementioned main carrier body 12 is a plurality of spaced elastic tension supports or hangers 14. As shown in FIG. 3, these elastic tension supports or hangers 14 are spaced at regular intervals, however, it is to be understood that they may be set in a random pattern or any other array as desired. Such variation of the spacing of the tension supports 14 is within the intent and scope of this invention.

Attached to the elastic tension supports 14, and hanging therefrom, is the array of a plurality of attractive toy-like elements 16, 18, 20, 22, and 24 (each described in detail hereinafter).

The multi-faceted units 16 may have any number of sides or facets and may be in multi-colors, as illustrated by the hatched markings, in order to attract the attention of a child patient. The multi-faceted units 16 may be wood, plastics, or any other suitable material, and any variation in material is within the scope and intent of this invention. These multi-faceted units 16 may be fixed on the elastic tension supports 14, but preferably are loose and slide up and down on the elastic tension supports 14.

Suspended from and attached to the bottom end of a plurality of a portion of the elastic tension supports 14 that carry the multi-faceted units 16, and just clear of said multi-faceted units 16, are a plurality of rings 18. These rings 18 may be varied in size from a "finger" ring to a "hand" ring for purposes of gripping.

The rings 18 may be metal, plastics, or any other suitable material and such variations of materials is within the scope and intent of the invention.

Suspended from and attached to the ends of a plurality of other elastic tension supports 14 are a plurality of balls 20. These balls 20 may be of various colors, as illustrated by the hatched markings, in order to attract the attention of the child patient.

These balls 20 may be wood, plastics, or other suitable materials. It is to be noted that any variation in the materials for the balls 20 is within the scope and intent of this invention.

It is also to be understood that the multi-faceted units 16 and the balls 18, may be either hollow, solid, or a composite, and such variation is within the scope and intent of this invention.

In a similar manner, suspended from and attached to the ends of a plurality of other elastic tension supports 14 are a plurality of small rocket-type paddles 22 with handles 24. The color of these rocket type paddles 22 may be of various colors in order to attract the attention of the child patient, similar to the other toy-like elements hereinbefore described.

It should be understood that other attractive toy-like elements may be used in place of the aforementioned multi-faceted units 16, rings 18, balls 20, and rockets 22 (with handles 24). The selection of toy-like elements is optional so long as they provide some degree of usefulness in a physical therapeutic process. For example: for gripping (such as the ring 18, ball 20, or handle 24), holding (such as the ball 20 or handle 24), pulling (such as the ring 18 or ball 20), maneuvering (such as moving the paddle 22 as a bat), coordination for a combination of these physically therapeutic operations (such as striking the ball 20 with the paddle 22), and other similar actions.

Variation of the attractive toy-like units to meet the aforementioned purposes is within the scope and intent of this invention.

The use of the muscles by the child patient in the physical therapeutic processes is provided by the elastic tension supports 14. These elastic tension supports 14 can be varied in the magnitude of the force required to pull them downward or to move them in a sidewise motion, by varying the size of the elastic material.

The variation of the tension magnitude hereinbefore described can be accomplished by having a plurality of tensile strengths in the array. It can also be accomplished by having the same tensile strength in the entire array, but increasing it as the child patient develops muscle strength or the ability to cope with the tensile strength represented in the array of elastic tension supports 14 that are in place in the treatment system 10 at the time.

Figure 2:
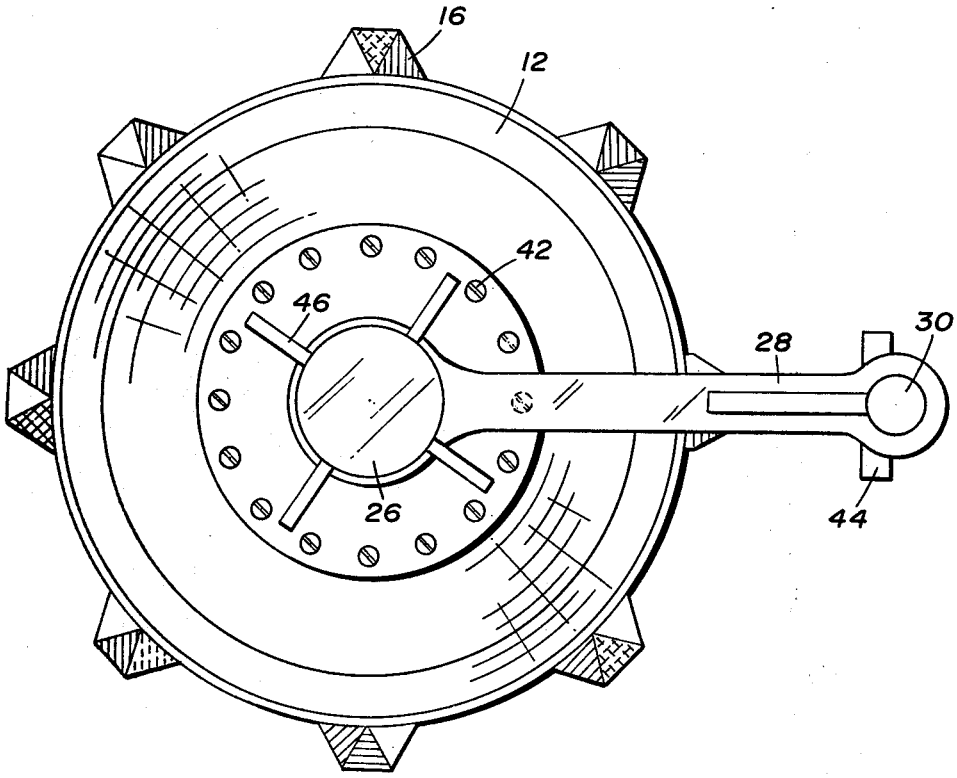
FIG. 2 is a top plan view of the Physical Therapeutical Treatment System.

The variation of the tension magnitude may also be adjusted by reducing the length of the elastic tension support 14 by turning the "take-up" screws 42 in FIG. 2 to reduce the length (similar to the action of the tuning screw on a string of a violin or guitar).

The horizontal spacing of the array of the aforementioned attractive toy-like elements may be seen in FIG. 3. The toy-like elements around the outer periphery of the main carrier body 12 (in this case the multi-facted units 16 and the rings 18) are spaced to the outside periphery from the take-up screws 42 by passing over built-in rings 56, 58, and 60 on the underside of the main carrier body 12. The threading of the elastic tension supports 14 over these built-in rings 56, 58, and 60 can be seen in FIG. 3.

The horizontal spacing of the array of the aforementioned attractive toy-like elements at the interior of the array is essentially directly downward from the take-up screws 42 directly above them (in this case the balls 20 and the paddles 22 with handles 24).

It should be understood that the use of the take-up screws is optional. The array of the plurality of attractive toy-like elements may be accomplished by merely passing the upper ends of the elastic tension supports 14 through suitable apertures (not shown) in the main carrier body 12 (directly above the toy-like elements) and securing said elastic tension supports 14 on the outside of the main carrier body 12 by a simple large knot (not shown), or by passing the end of the elastic tension support 14 through a retainer button (not shown) in order to hold the elastic tension support 14 in place.

It must be understood that any variation in the number of attractive toy-like elements, the configuration of these elements, or the pattern of the spacing of these elements, is within the scope and intent of this invention, as such variations do not alter the physical therapeutic process of this invention.

Returning now to FIG. 1 and to FIG. 2, the main carrier body 12 is suspended at its center from a support arm 28. The support arm 28 is equipped with a cantilever bearing socket 30 for connection to a support post 32.

The bearing socket 30 may be fastened to the support so as to permit it to swivel or it may be held in a rigid position by a pin (not shown) or machine screw (not shown). The bearing socket 30 may also be made as a press fit on the support post 32. When the bearing socket is permitted to swivel it provides flexibility for an attendant to the child patient; the physical therapeutic system 10 structure may be moved to one side while attending the child patient for other necessary requirements of attention.

Figure 4:
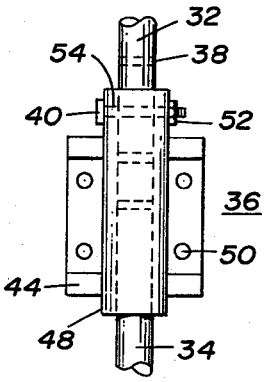
FIG. 4 is a section taken on line 4—4 of FIG. 1.

In turn, the entire physical therapeutic system 10 structure is mounted to the side of a crib, play pen, or other enclosure or facility in which, or on which, the child patient is placed. The mounting of the therapeutic system is accomplished with a mounting bracket 36. The mounting bracket may be in various configurations, one of which has been shown on the drawing in FIGS. 1, 3, and 4.

The mounting bracket 36 comprises a flange 44 attached to a sleeve 48 with a plurality of mounting holes 50 for attaching the mounting bracket 36 to the side of a crib, play pen, or other facility with screws or bolts. The support post 32 is inserted into and through said sleeve 48 of the mounting bracket 36 as shown in FIG. 1 and extends out through the bottom of said sleeve as shown at the bottom end 34 of support post 32. Said support post 32 and said sleeve 48 may be either round, square, or any other configuration so long as they match.

To position the therapeutic system 10 at various heights to suit the size of the child patient, the support post 32 has a plurality of holes 38 through the support post 32 with a matching hole 54 through the sleeve 48. When the therapeutic system 10 is at the desired height, a pin or bolt 40 is inserted through the selected support post hole 38 and through the matching sleeve hole 54 to hold the therapeutic system 10 structure in position. A nut 52 is placed on the end of the bolt 40 to secure it. The holes 38 and 54 and the pin or bolt 40 serve as an indexing means.

It should be understood that a variety of known methods may be used for some of these latter mechanical requirements. For example: when a pin is used instead of the bolt 40, a cotter pin or other means may be used to secure the pin in place instead of the nut 52; a channel-shaped flange may be attached to the side of the sleeve for fitting over the top rail of a crib instead of a flush flange 44; set screws or thumb screws may be used with said channel-shaped flange to fasten it to the crib or other facility instead of wood screws or bolts as specified for the flange 44; and set screws or thumb screws may be used to hold the support post in position in the sleeve 48 instead of a bolt 40. All such variations are incidental to the use of the therapeutic system 10 and are within the scope and intent of this invention.

The attachment of the main carrier body 12 at its center to the support arm 28 may be by a simple bolt and nut at the center. However, as shown in FIG. 1, a music box 26 playing tunes known to children, or recorded messages speaking to the child patient, may be used as the nut end of a simple nut and bolt connection. In this case a stud extends from center of the main carrier body 12 up through the support arm 28 and an internal thread at the bottom center of the music box 26 permits the music box assembly to be used as the unit in place of an ordinary nut on the stud from the main carrier body 12.

The plurality of arms 46 on the music box may be used to provide manual circular movement to the therapeutic system 10 to attract the attention of the child patient.

This physical therapeutic system 10 differs from the mere ordinary hanging eye-appeal toys used in cribs. The elastic tension supports 14 are in calculated magnitudes for therapeutic programs of a series of advancement exercises, the heights of the various objects can be varied in connection with the therapeutic programs as the ability and capability of the child patient advances, and the combination of objects (such as the paddle 22 and the ball 20) are such that coordination activity is included in the therapeutic programs. Thus, the invention accomplishes the physical therapeutic activities by a programable method, using child attraction devices.

If desired, a strain gage can be coupled in the system at the end of elastic tension members 14 to measure the pull on the particular string or strings to ascertain if the tension in the elastic tension members 14 should be adjusted for progressive development of the patient.

As can be readily understood from the foregoing description of the invention, the present structure can be configured in different modes to provide the ability to conduct a physical therapeutic process with child patients. Accordingly, modifications and variations to which the invention is susceptible may be practiced without departing from the scope of the appended claims.

What is claimed is:

1. A physical therapeutical treatment system, comprising:

a plurality of spaced suspended toy-like objects;

a plurality of support means, each said support means having one of said toy-like objects affixed to the lower end thereof, said plurality of support means having a range of tensile strength distributed among said plurality of support means;

a support structure to which said plurality of support means are connected by their upper ends in spaced relation to each other;

a mounting means to which said support structure is affixed; and a tension adjusting means affixed to the upper end of each said support means by which the tension in each said support means may be varied in magnitude.

2. The physical therapeutical treatment system as recited in claim 1, wherein said plurality of spaced suspended toy-like objects consists of:

a plurality of multi-faceted units in varying colors with mounting holes therethrough, said multi-faceted units being spaced from other toy-like objects;

a plurality of rings spaced from said multi-faceted units;

a plurality of balls in varying colors spaced from said multi-faceted units and said rings; and a plurality of paddles spaced from other toy-like objects.

3. The physical therapeutical treatment system as recited in claim 1, wherein said plurality of support means having a range of tensile strengths consists of elastic cord-like members on each of which said plurality of toy-like objects are suspended, one toy-like object to each said cord-like member, said range of tensile strengths being distributed among and throughout said plurality of support means, further, a tension adjusting means is affixed to the upper end of each support means by which the magnitude of the tension may be varied.

4. The physical therapeutical treatment system as recited in claim 1, wherein said support structure consists of:

a carrier body for said plurality of toy-like objects suspended on said plurality of support means attached to said carrier body;

a support arm from first end of which said carrier body is suspended at center of said carrier body;

a support post on which said support arm is mounted;

a bearing member attached to second end of said support arm for mounting said support arm on top of said support post;

a mounting bracket affixed to a child patient's facility and surrounding a portion of exterior surface of said support post;

an indexing means communicating between said mounting bracket and said support post to locate said support post at varying heights within said mounting bracket.

5. The physical therapeutical treatment system as recited in claim 4 wherein said indexing means comprising:

a plurality of spaced round holes in and through said support post;

a matching round hold in a pipe-like member of said mounting bracket and through which said pipe-like member said support post passes so that each of said spaced round holes in said support post can be aligned and communicate with said matching hole in said pipe-like member of said mounting bracket;

a bolt-type member to pass through said aligned holes to hold said support post in a selected fixed position within said pipe-like member of said mounting bracket; and a securing means for said bolt-type member to secure said bolt-type member in place.

* * * * *